United States Patent [19]

Gentry

[11] Patent Number: 4,473,995

[45] Date of Patent: Oct. 2, 1984

[54] CONCENTRIC COMPRESSED DOUBLE TWIST STRANDED CABLE

[75] Inventor: Bobby C. Gentry, Temple, Ga.

[73] Assignee: Southwire Company, Carrollton, Ga.

[21] Appl. No.: 462,843

[22] Filed: Feb. 1, 1983

[51] Int. Cl.[3] ..... D07B 3/10; D07B 5/10; D07B 7/14

[52] U.S. Cl. ..... 57/9; 57/6; 57/58.65; 57/215

[58] Field of Search ..... 57/3, 7, 9, 13, 15, 57/215, 58.49, 58.52, 58.65

[56] References Cited

U.S. PATENT DOCUMENTS

| | | | |
|---|---|---|---|
| 2,156,652 | 5/1939 | Harris | 57/9 |
| 3,130,536 | 4/1964 | Peterson et al. | 57/9 |
| 3,395,528 | 8/1968 | Lucht | 57/9 X |
| 3,444,684 | 5/1969 | Schoerner et al. | 57/9 |
| 3,812,666 | 5/1974 | Sarrachino | 57/58.65 X |
| 3,942,309 | 3/1976 | Cahill | 57/9 |
| 4,133,167 | 1/1979 | Schofield | 57/58.65 X |
| 4,212,151 | 7/1980 | Schauffelle et al. | 57/9 |
| 4,311,001 | 1/1982 | Glushko et al. | 57/9 X |
| 4,328,662 | 5/1982 | Bretegnier et al. | 57/58.65 X |

*Primary Examiner*—Donald Watkins

*Attorney, Agent, or Firm*—Herbert M. Hanegan; Robert S. Linne; Michael C. Smith

[57] ABSTRACT

A process for the manufacture of concentric compressed or compacted stranded conductors at high speed on double-twist bunching machinery while eliminating loose strand, strand crossovers, and spiral propensity of the finished product; and the product thereof.

9 Claims, 3 Drawing Figures

CONCENTRIC COMPRESSED DOUBLE TWIST STRANDED CABLE

TECHNICAL FIELD

This invention relates generally to stranded cable manufacturing, and more particularly to a manufacturing process for producing compressed concentric stranded cable with high speed, double twist, bunching machinery; and cable produced thereby.

BACKGROUND ART

Compressed stranded cable is well known in the art. Examples are disclosed in U.S. Pat. Nos. 3,383,704 and 3,444,684. Such cables are preferred over uncompacted cables for several reasons.

Uncompacted cables require the maximum amount of insulation because the cable diameter is not reduced and because superficial valleys between the outer strands are filled with insulation material. In addition, since uncompacted cables are not generally tight-stranded, extrusion of insulation onto the stranded cable usually forces insulation material into the interstices between the individual strands of the cable. In addition, tension on the individual strands of uncompacted cable is usually unequal, which can result in a propensity of the cable to assume a spiral or sine wave configuration.

U.S. Pat. Nos. 3,383,704 and 3,444,684 disclose an advantageous process and compacted cable wherein a plurality of layer strands are wound about at least one core strand and each layer strand is deformed to form a flattened region along the length of the layer strand while leaving the layer strand substantially circular and without deforming the core strand.

Many different types of stranding machines may be used for stranding layer strands over core strands. Examples of tubular type stranders are disclosed in U.S. Pat. Nos. 3,827,225 and 3,902,307. Rigid frame and circular mil type stranders are shown in U.S. Pat. Nos. 3,280,544, 3,934,395, 3,955,348 and 4,253,298. Double-twist stranders are shown in U.S. Pat. Nos. 3,791,131, 3,945,182 and 4,087,956.

While rigid frame and circular mill type stranders have been found satisfactory in producing compressed stranded cable in sizes larger than AWG 4/0 and when more than nineteen wires are used to form the cable, tubular stranders have been preferred in the compressed stranded cable industry for smaller cables. Normal technology is tubular stranders for seven wire and nineteen wire configurations. The tubular stranders, however, are limited to 1,000 rpm when producing seven wire cable and about 700 rpm when producing nineteen wire cable on the larger twelve wire machines. Although tubular stranders are usually marketed for speeds of 1,000 rpm, it is very difficult to exceed 700 rpm while producing the twelve wire layer without breakout problems. Tubular stranding of nineteen wire cable requires one seven wire machine and one twelve wire machine, resulting in a two-pass production cycle for nineteen wire cable.

Double-twist stranders are designed for bunching. Bunching is the random assembly of any number of wires, by simply twisting the single ends together. Stranding is geometrically controlled assembly of the wires in layers, each wire being guided into a specific location within its layer. The capital expense of one buncher is about half that of the two tubular machines which would be required for the same production.

Economies favoring double twist bunchers over tubular stranders are also evident in electrical drive power and the reduced level of spare parts and maintenance required. Double-twist bunchers, although generally capable of higher productive speed than the other types of stranding equipment, have not been used in the compressed stranded cable art because of numerous strand alignment problems, including loose strands, bird caging, wire crossovers, and inability to keep the core within the strand layer. In short, it has not been a practice to manufacture compressed stranded cable on double-twist bunchers.

DISCLOSURE OF INVENTION

It is therefore a primary object of this invention to provide an improved process for manufacturing concentric compressed stranded cable on a double-twist bunching machine at high speed.

The concentric compressed stranded cable produced by this process is a multiple layer conductor with each layer having six more strands than the previous layer. Thus, the core strand would contain a single core wire, the first layer would contain six strands, the second layer would contain twelve strands, etc.

A conventional double twist buncher exerts high tension on the core wire and first layer, which is amplified by compression, resulting in elongation of the strands and reduction in the overall diameter. The reduced diameter does not properly accommodate the second layer and crossovers and loose strands result. In addition, compression during the second pass is transferred into the core wire and first layer which can result in loose strands and crossovers in the first layer. Related stress problems are: keeping the core inside the first and second layers, and keeping the first layer inside the second layer. String up of the twelve wires of the second layer over the six wires of the first is also a tedious problem.

By altering the dimension of the strands of the core wire and first layer to compensate for high tension compression elongation, prestranding certain layers well before compression, and unstranding and restranding certain layers before compression, the process of the primary object discussed above results in a second major object, the concentric compressed stranded cable.

The normal geometry between layers must be altered to provide the required surface area (circumferential) after compression and elongation to accommodate the intimate contact of the next layer wires prior to the compression die. If normal cable geometry is used, the surface area of the first layer after compression is insufficient to permit the oncoming layer to fit, resulting in a "high" wire which will eventually be backed up by the compression force to the point where it will break. It is sometimes necessary to also decrease the diameters of the second layer wires, in addition to increasing the first layer diameter, to optimize the production performance.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

BEST MODE FOR CARRYING OUT THE INVENTION

Figure 1:
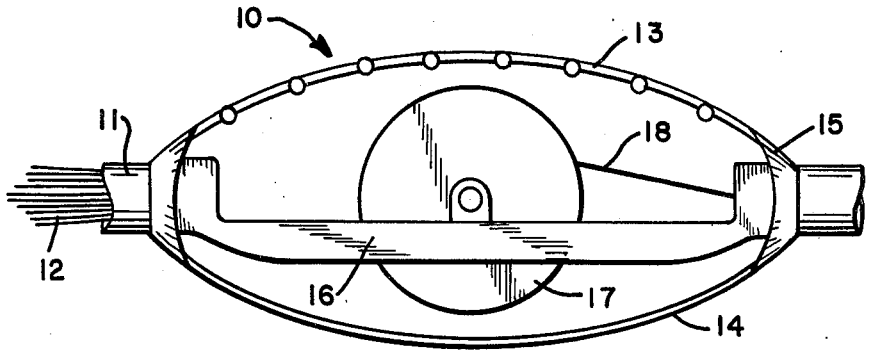
FIG. 1 (Prior Art)
FIG. 1 is a side view of a conventional double-twist bunching machine.

As FIG. 1 illustrates, the prior art double-twist bunching machinery indicated generally at 10 comprises an entrance means 11 for the entrance of a core and layer strands 12, a strand bow 13 along which the strands 12 are guided, a counter bow 14 to balance strand bow 13, a reversing means 15 for directing strands 12 toward inner portions of the mechanism 10, a cradle 16, and cable collection means 17.

As the strands 12 advance through entrance means 11, which is stationary and reach strand bow 13 which rotates, strands 12 receive a first twist. The strands 12 continue along strand bow 13 to reversing means 15 which is stationary and thus strands 12 receive a second twist as their direction is reversed and their rotation terminates. Cradle 16 is stationary and supports cable collection means 17 which is also stationary along the longitudinal axis of the buncher 10, but rotates along an axis perpendicular thereto in order to collect the double twisted cable 18.

The cable of the present invention is generally of the type specified in the Underwriters Laboratories Inc. Standard For Rubber-Insulated Wires and Cables - UL 44. At section 9, the cable is described as: "A compressed-stranded conductor shall be a round conductor consisting of a central core wire surrounded by one or more layers of helically laid wires with, for the No. 6 AWG - 2000 MCM sizes, the direction of lay reversed in successive layers. After assembly, the conductor shall be rolled, drawn, or otherwise compressed as a whole to slightly distort the originally round strands to various shapes that achieve filling some of the spaces originally present between the strands."

The products of this process include from AWG 8 through AWG 4/0 cable. This entire range is available in nineteen-wire configuration. The range of AWG 8 through AWG 2 is also available in seven-wire configuration. Additionally, seven wire core is produced for mcm sizes ranging from 250 through 1,000. Acceptable seven and nineteen wire semi-c construction is possible using a high-speed double-twist buncher. As with tubular stranders, the nineteen wire construction requires double-pass production cycle on this machine, however, at a much higher speed (2,500 twists/minute). Use of the double-twist principle eliminates the need to stop production to change pay-off packages of single-end.

To avoid confusing the present process with the bunched conductor process, for which double twist bunching machinery was designed, a bunched conductor is defined as a conductor formed of a random assembly of any number of wires by simply twisting the single ends together, and compressed stranded cable is defined as a multiple layer conductor with each layer containing six more wires than the previous layer wherein individual wires are prevented from migrating into other layers, lay direction may be reversed in successive layers (as discussed in UL 44) or may be unidirectional, and layers are compressed to reduce the nominal overall diameter by approximately three percent.

Tensions on the core wire and first layer of six wires in double-twist bunchers are much greater than found in tubular and rigid frame type stranders which causes the seven wire core to elongate. This, added to the forces of compression, reduces the core wire and first layer diameter which leaves a circumference too small to accommodate the outer twelve wire layer. This causes some strands to remain high and crossover at the compression die. By using individual wires of larger diameter in the first layer, with normal amount of compression, according to this invention, the overall diameter is increased to retain the required circular mil area and diameter after compression.

To compensate for high tension compression, the conventional geometry between layers is altered to provide the requisite circumferential surface area after compression and elongation to accomodate the intimate contact of the subsequent layer of wires prior to the compression die. For example:

| | | Wire Dia. | | Gears | | Sizing Die | | Closing | |
|---|---|---|---|---|---|---|---|---|---|
| Cable | Layer | Min. | Max. | A | B | Min. | Max. | Die | Tension |
| 6-19 A.S. | 6 wire | .0400 | .0403 | 20T | 80T | .1095 | .1100 | .122 | 7-8# |
| | 12 wire | .0370 | .0372 | 39T | 61T | .1790 | .1795 | .187 | 7-8# |
| 4-19 A.S. | 6 wire | .0500 | .0505 | 23T | 77T | .1365 | .1370 | .153 | 10-12# |
| | 12 wire | .0470 | .0473 | 45T | 55T | .227 | .2275 | .234 | 10-12# |

Wire diameters smaller than above will result in failing Wt./m' or loose strand in outer layer. Wire diameters larger than above will cause stranding problems such as bird-cage and breakouts.

Figure 2:
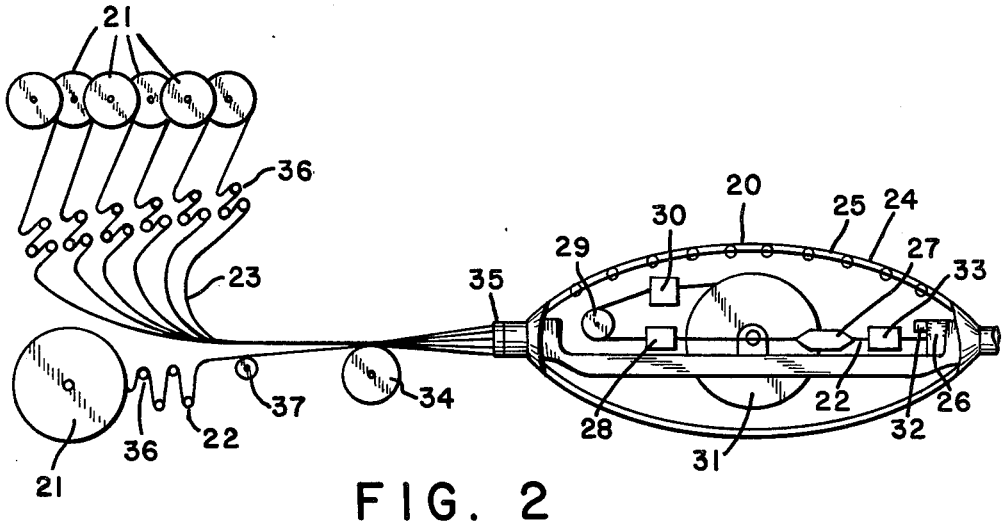
FIG. 2 is a side view of a double-twist bunching machine adapted to perform the process of the present invention.

FIG. 2 illustrates a double-twist bunching machine 20 adapted to perform the process of the present invention. Three types of cable are produced by these adaptations: a seven wire cable; a nineteen wire cable having reverse-direction layers of strand; and a nineteen wire cable having unidirectional layers.

String up of a double-twist buncher was a major problem in the past. This is overcome by stringing the outer twelve wires completely through the machine with the final compressing die installed and placed after the second twist, but before the capstan wheel. Thus, the seven-wire core or cable is run through a compressing die inside the bows of the buncher.

As FIG. 2 illustrates, the unique adaptations begin with a special pay-off 21, provided on the input side of the buncher to input the seven-wire core and the layer wires of nineteen-wire constructions. The pay-off principle used herein is the flyer concept from spools. While general operating considerations are applicable to other types of pay-off as well, the flyer concept is chosen as preferred due to difficulties of tenstioning usually associated with roll-off types. The wire-to-wire tensioning equalization is an important consideration to efficient compressed stranding on the double-twist machine.

The resting position of the pay-off spool is at an angle of not less than 45° with respect to the flange and floor. This is to prevent turns of the wire cascading down the spool in the event tensioning is momentarily lost. The pay-off unit is also equipped with a means for guiding the turns of wire over the spool flange toward the buncher. The preferred choice is a spinner-disc, sized to permit nesting of the spool flange inside its outer guide surface to eliminate the worries of trying to maintain a smooth, burr-free surface on the spool flange.

Means for wire tensioning is provided on the pay-off unit. Despooling tension needs to be sufficient only to control the wire path close to the spool, overcoming the centrifugal reaction. This can be accomplished by using either a braked-pulley system or a whisker-disk arrangement. In either case, the wire must be guided to an alignment point with the center of the spool at a distance of approximately 1½ times the spool traverse length from the pay-off flange. Stranding tension is controlled further downstream. Once the wire exits the pay-off guide, the wire can be turned up to 90° with no adverse effects on the pay-off performance.

The fabrication of compressed strand contra-lay on the double-twist machine is a two pass operation. First, the seven wire core is produced. The tensioning requirements for this assembly is not as critical as the 12-wire pass. However, there are two points of tensioning provided in the system. The first is the wire accumulator rolls 36 which are supplied for the primary purpose of providing additional stopping length when a spool runs out, or a wire break occurs. This extra length prevents the wire end from entering the strander where splicing would not be possible. These accumulator rolls 36 even the pay-off tension from wire-to-wire. Since the accumulator rolls 36 are rotated by the wire movement, and are solid cylinders, they have a metering effect on the wires. The wires then are wrapped one turn around the tension drum 34 and tension is adjusted to a level just high enough to keep the wire steady. Adjustment is made conventionally by a handknob that actuates a brake calipers on a brake disc. The center wire of the 7-wire core is strung around tension wheel 37, because slightly more tension is needed on this wire. This is necessary because the center wire feeds at a reduced rate compared to the six outer wires, since they must have extra length for wrapping around the center wire.

When the machine is set up to apply the 12-wire layer over the 7-wire core, the twelve wires are threaded through the accumulator rolls 36 and then around the tension drum 34. The reel of fabricated 7-wire core is set up on the pay-off unit and the disc brake is set to produce a fairly tight tension. It is then passed through the guides, to the tension wheel where it is wrapped once and adjusted to a level slightly higher than the pay-off tension. Usually, a tension force of 30–40 lbs. will be sufficient for the process.

The back-tension pay-offs 21 produce the high back-tension required for the application of the twelve wire layer 23. Certain techniques have proven more time-effective for getting the wires through the machine ready for production. The center wire for the 7-wire core is threaded through the center hole in the lay-plate 35. The six outer wires are threaded through every other hole in the twelve-hole circle on the lay plate 37. The lay plate is adjusted to cause an angle of about 30° on the outer wires between the lay plate and closing die. This will help tension the wires and prevent cross-overs. A closing die is chosen with an opening about 0.002 inch (0.051 mm) larger than 3 times a single end diameter. For example, where single-ends measure 0.025 inch (0.635 mm), the closing die size would be 0.077 inch (1.956 mm) diameter. As the core 22 and the layer wires 23 advance, they proceed along the bow 25 to a turn around sheave 26. The machine gearing is set to produce a lay length of approximately one-half the nominal length required for the outer layer. This causes the cable 24 to have the nominal lay length from point of closing to the sheave 26 which makes the second twist.

The bows 25 in the improved buncher are steel-reinforced, leading to the large turn-around sheave 26 (approximately 18") which directs the twisting cable under a drop-oiler 32, through a water-cooled sizing die 33. The seven wire core 22 is tapered for a distance of approximately 24 inches by tapering means 27 which removes six outer wires with approximately four inches between each wire. After the core 22 is guided into the center of the outer wires and runs about one-half the length of the bow 25, gears are then changed back to the nominal lay length and the cable run through the compressing die 28, around the capstan 29, through an adjustable traversing unit 30, and onto the take-up reel 31.

For twelve wire operations the reel of the previously assembled seven-wire core is set up on the reel pay-off unit 21 and pulled up around the tension wheel 37, to the center of the lay plate 35. The twelve wires are threaded through the accumulator rolls 36, around the tension drum 34, and to the lay plate 35. A closing die is chosen which is approximately 0.002 inch (0.051 mm) larger than the sum of the diameters of the seven-wire core and two-wire diameters. Next, the twelve-wires are pulled through the machine as a unit. A sizing die (sized to the desired final diameter of the product) is put into place and the twelve wires pulled through, around the capstans and attached to the take-up reel. Then, a set of lay-length gears are chosen to produce a lay length of about half the desired final lay. Again, this is to produce a tight strand in order to "grab" the seven wire core. The machine is rotated slowly until tension is even in the 12 wires, then the seven wire core is inserted in the center of the twelve wires at the closing die. The machine is rotated until the end of the seven wire core has reached about midway of the bow. At this point, the machine is stopped and the proper lay length gears put into the gear box. The machine is slowly rotated until the proper lay length has reached the take-up reel, and the machine is ready to begin production.

The act of compressing the strand is done to reduce the overall diameter and reduce the amount of volume of the interstices of a given strand size to lower the amount of insulating material required during extrusion. (See U.S. Pat. No. 3,383,704, "Multi-Strand Cable" and U.S. Pat. No. 3,344,684, "Method of Forming a Multi-Strand Cable"). For example, consider an AWG 6–19 wire strand, the economics calculations show:

Concentric stranded dia. = 0.186 inches

Compressed stranded dia. = 0.180 inches

When insulating with 0.045" of PVC with a specific gravity of 1.4, the weight of the plastic coating per 1,000 ft. is determined by the following formula:

$$W=1360(D+T)\ TP$$

Where:

W=Pounds of plastic per 1000 ft.

D=Core dia. in inches

T=Wall thickness in inches

P=Specific gravity of the plastic

Weight of plastic for concentric strand:

$$W=1360(0.186''=0.045'')(0.045'')(1.4)=19.79$$

Weight of plastic for compressed strand:

$$W=1360(0.180''+0.045'')(0.045'')(1.40)=19.28$$

Therefore, there would be a 2.6% saving in compound just from the reduction in diameter. If the calculations are made to compensate for the differences in volumes of interstices, the compressed strand will show a nominal difference of approximately 3.5%. This construction is a very desirable design, purely from the economics involved.

The production of compressed contra-lay 19-wire strand on a double-twist machine requires a change in the usual practice of singe-end sizing and geometry of the layers. Since the seven-wire core is assembled separately and since the strand will be assembled several feet before final sizing, the provision must be made in layer geometry for all wires to fit. Also, the amount of pull-down must be compensated for by increasing single-end diameters to assure circular-mil area and weight are maintained. Thus, the following formulas have been derived, and the values have been proven empirically on regular production basis. All that is known from the start is the finished wire size and the construction of one wrapped by 6 wrapped by 12 or 19 wires. UL-83, Table 10.4 provides the finished diameter. Tolerances are tightened while making sure that the finished strand doesn't fall undersize. (See Table I below.)

Figure 3:
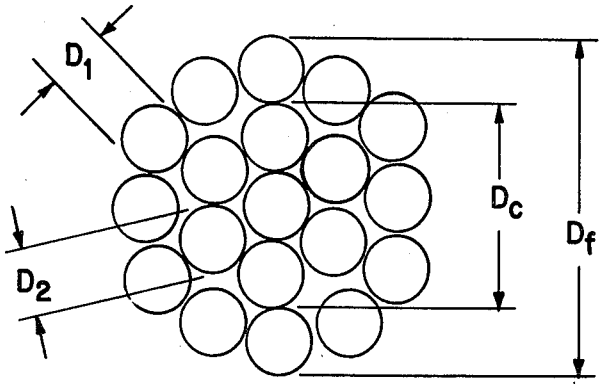
FIG. 3 is a cross section of compressed cable produced by the process of the present invention.

Referring now to FIG. 3, which shows the cross section of cable manufactured by this process, $D_f$ is the minimum diameter of the finished 19 wire cable, $D_c$ is the maximum diameter of the seven wire core, $D_1$ is the minimum diameter of the individual outer layer strands and $D_2$ is the maximum diameter of the individual inner layer strands.

To determine the size to draw the wires for the outside layer, set $D_f$ to the absolute minimum value in the range for the finished diameter.

$$D_1 = D_{\frac{f+\%}{5}}$$

Note:

(1)% = 3.3% for AWG 6, adding 0.1% for each AWG increase in dia. and subtracting 0.1% for each AWG decrease in dia. for other sizes.

(2)Set dia. tolerance for $D_1$ to ±.0001" on AWG 6.

(3)Set dia. tolerance for $D_1$ to ±.00015" on AWG 4.

The sizing die to use for the 7-wire core will be a maximum value, and the minimum value for $D_1$ in the calculation is used.

$$D_c = D_{\frac{1\times N}{3.14159265}} - D_1$$

Note:

(1)$N$ = 12.5 for AWG 6, subtracting 0.1 for each AWG dia. increase, and adding 0.1 for each AWG dia. decrease for other sizes.

(2)Tolerance +0, −.0005"

The wire size to draw for the first pass is also a maximum value, and the maximum value for $D_c$ is used.

$$D_2 = D_{\frac{c+10\%}{3}}$$

Note:

(1)Tolerance +0; −.0003" for AWG 6

Tolerance +0; −.0005" for AWG 4

TABLE I

| | | | AWG 6 | AWG 4 |
|---|---|---|---|---|
| Sizing Die | ($D_f$) | 12-wire layer | .1790"–.1795" | .2270"–.2275" |
| | ($D_c$) | 7-wire layer | .1095"–.1100" | .1365"–.1370" |
| Wire Dia | ($D_1$) | 12-wire layer | .0370"–.0372" | .0470"–.0473" |
| | ($D_2$) | 7-wire layer | .0400"–.0403" | .0500"–.0505" |

The double-twist method of producing contra-lay strand poses a new consideration in the normal twisting concepts. Since the seven-wire core assembly is subjected to additional twisting in the application of the twelve-wire layer, provision must be made to compensate. Since this is contra-lay, the seven-wire core will be untwisted during the second pass. This relationship may be calculated as desired to determine the starting lay for the seven wire core.

An arithmetical explanation of the effect of an additional twist imparted by a fixed bobbin laying up machines such as bunchers, drum twisters, rigid stranders (with supply bobbins in fixed axial positions). Let the:

| | |
|---|---|
| Center Lay (as first made, usually 7) = | A |
| Center Lay Direction = | $RH_A$ or $LH_A$ |
| Outer Lay = | B |
| Outer Lay Direction= | $RH_B$ or $LH_B$ |

For twist directions adding (i.e. $^{RH_A}$ twisted $^{RH_B}$ or $^{LH_A}$ twisted $^{LH_B}$) one extra twist is imparted into the center for each cable lay B.

For twist directions subtracting (i.e. $^{RH_A}$ twisted $^{LH_B}$ or $^{LH_A}$ twisted $^{RH_B}$) one twist is extracted from the center for each outer lay B.

Lay in the center conductor is calculated:

$$\frac{B}{A} = \text{Number of twists per } B \text{ before additional twisting.}$$

If one twist is added or subtracted per $B$ then $\frac{B}{A} \pm 1$ = Number of twists in the center per $B$ before additional twisting.

Let the final twist length of the center=C $$= \frac{B}{\frac{B}{A} \pm 1} = \frac{B \times A}{B \mp A}$$

$$\text{i.e. } C = \frac{B \times A}{B \mp A}$$

The usual reaction by insulators in the art to double-twist strand is "I can't insulate over the wavy strand produced by double-twist machines". This objection is completely overcome by a combination of the compressed cable concept and the fact that all compression is done after the strand is assembled. The normal helical pattern imparted by double-twist machines is completely removed by the metal working stresses imparted during the compression step. Also, since this is done subsequent to all twisting, the compressed surfaces on each wire remain in place to produce a smooth, straight strand ideally suited for insulating machines. This, combined with the 3.5% insulating materials savings associated with compressed strand, offers substantial conversion cost reductions to the cable fabricator.

The usual spiral found in double-twisted cables is not present in this concept. Instead, cable of the present invention is characterized by linear propensity. Due to the straightening effect, after completion of the twisting, by the semi-c compressing die, and this double pass process provides about twice the output of that available with conventional tubular stranders.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitation in the wire and cable industry and is particularly useful in a system for producing concentric compressed or compacted stranded cable at high speed on a double twist bunching stranding machine.

What this invention claims is:

1. A method of producing concentric compressed double twist stranded cable comprising the steps of:

(a) reducing the diameters of each wire of a first group of individual wires;

(b) guiding said first group of wires onto the outer surface of a core wire; and (c) compressing said first group of wires into a concentric first layer on said core wire to form a seven wire core.

2. The method of claim 1 further comprising the steps of:

(d) reducing the diameters of each wire of a second group of individual wires;

(e) guiding said second group of wires onto the outer surface of said seven wire core; and, (f) compressing said second group of wires into a concentric second layer on said first layer to form a 19-wire cable.

3. A method of producing concentric compressed double twist stranded cable comprising the steps of:

(a) causing the diameter of each wire of a first group of individual wires to conform to the following equation:

$$D_2 = \frac{D_c + 10\%}{3}$$

where $D_2$ is the diameter of each wire of said first group of wires and $D_c$ is the maximum diameter of a seven wire core to be formed from said first group of wires;

(b) guiding said first group of wires onto the outer surface of a core wire;

(c) compressing said first group of wires into a concentric first layer on said core wire to form a seven wire core;

(d) altering the diameters of each wire of a second group of individual wires;

(e) guiding said second group of wires onto the outer surface of said seven wire core; and (f) compressing said second group of wires into a concentric second layer on said first layer to form a 19-wire cable.

4. The method of claim 3 wherein step (d) further comprises the step of:

(h) causing the diameter of each wire of said second group of wires to conform to the following equation:

$$D_1 = D_{\frac{f+X}{5}}$$

where $D_1$ is the diameter of each wire of said second group of wires, $D_f$ is the minimum diameter of said 19-wire cable, and X equals a specific percentage which varies as the cable diameter varies.

5. The method of claim 4 wherein X is 3.3% for cable size AWG 6 and is increased by 0.1% for each AWG increase from AWG 6 and is decreased by 0.1% for each AWG decrease from AWG 6.

6. The method of claim 3 wherein step (c) further comprises the step of:

(i) causing said seven wire core to assume a maximum diameter conforming to the following equation:

$$D_c = D_{\frac{1\times N}{3.14159265}} - D_1$$

where $D_c$ is the maximum diameter of said seven wire core, $D_1$ is the minimum diameter of the individual strands of said second group of wires, and N is a specific factor which varies as the cable diameter varies.

7. The method of claim 6 wherein N equals 12.5 for cable size AWG 6 and is decreased by 0.1 for each AWG increase from AWG 6 and is increased by 0.1 for each AWG decrease from AWG 6.

8. The method of claim 6 further comprising the step of:

(j) forming an insulating covering over said compressed second layer, further provided that the volume of insulating material required is decreased by about 3.5%.

9. A concentric compressed stranded conductor formed by the method of claim 8 and characterized by substantially tight strand, substantially no strand crossovers and substantially linear propensity.

* * * * *